US005181847A

United States Patent [19]

Da Silva

[11] Patent Number: 5,181,847

[45] Date of Patent: Jan. 26, 1993

[54] LIGHTER-KEY-HOLDER ARRANGEMENT

[76] Inventor: Edilberto A. Da Silva, 1542-Campos Elíseos, Ribeirao Preto-Sao Paulo, Brazil

[21] Appl. No.: 795,459

[22] Filed: Nov. 20, 1991

[30] Foreign Application Priority Data

Aug. 12, 1991 [BR] Brazil ..... 7101793[U]

[51] Int. Cl.[5] ..... F23Q 2/32

[52] U.S. Cl. ..... 431/253; 431/343; 24/3 K; 24/265 H

[58] Field of Search ..... 431/253, 343, 356; 206/85, 86; 24/3 R, 3 K, 600.7, 265 H, 694

[56] References Cited

U.S. PATENT DOCUMENTS 2,465,328 3/1949 Modrey ..... 24/3 K
4,082,496 4/1978 Johnson ..... 431/343
4,430,778 2/1984 Sander ..... 24/3 K
4,486,169 12/1984 Lewis ..... 431/253
5,026,274 6/1991 Jacob ..... 431/343

*Primary Examiner*—James C. Yeung
*Attorney, Agent, or Firm*—Skjerven, Morrill, MacPherson, Franklin & Friel

[57] ABSTRACT

An improved lighter-key-holder arrangement, wherein the key-holder is independent from the lighter and comprises a detachable fitting having a cross-section similar to that of the lighter. The cross-section can be circular or rectangular. The fitting is coupled to the lighter by a threaded pin centrally formed thereon and received in a threaded bore hole centrally formed on the bottom surface of the lighter. The fitting is provided with a transverse opening that is closed by a latch actuated by a spring and manually operated by an external button. In another embodiment, the fitting has a cross-section different from that of the lighter. In yet another embodiment, the lighter body is spherical.

4 Claims, 3 Drawing Sheets

LIGHTER-KEY-HOLDER ARRANGEMENT

BACKGROUND OF THE INVENTION

1. Field of the Invention

This invention relates to lighters and, in particular, to a lighter-key-holder arrangement.

2. Related Art

Previously, there has been provided a lighter having a key-holder connected thereto by a chain or ring attached to the body of the lighter, whereby it can be used to light a stove. For this purpose, the lighter is provided with a key-holder ring directly attached to the lighter's body or connected thereto by a chain, which key-holder ring can be hanged from a hook or the like fastened to a wall near the stove. The lighter-key-holder comprises additionally a thread for connecting the lighter to the hook or the like to prevent the lighter from being removed from its proper position to serve other purposes or from accidentally falling off the hook.

SUMMARY OF THE INVENTION

An improvement was introduced in the above discussed arrangement, which comprises the lighter being provided with a detachable fitting, said chain and key ring connecting to said fitting in order to allow the removal and replacement of the lighter when required. This new arrangement provides several functional and economic advantages. The detachable fitting can be a continuation of the body of the lighter, in which case the fitting is provided with a latch to fasten the lighter-key-holder arrangement to a belt or to a waistband, or the fitting can be a key-holder accessory having means for coupling with the lighter.

The lighter has a rectangular, square or circular cross-section. The key-holder may have the same cross-section as the lighter or the key-holder may be a fitting with a cross-section that does not match that of the lighter.

DETAILED DESCRIPTION OF THE PREFERRED EMBODIMENTS

Figure 1A:
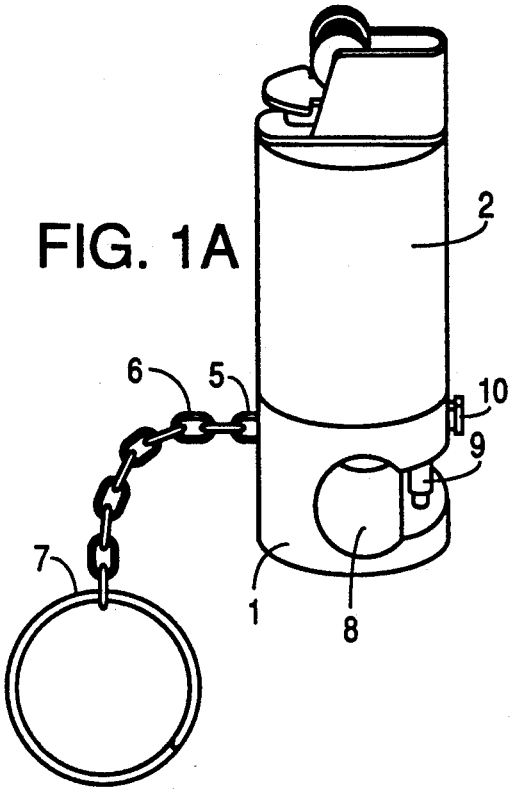
FIG. 1A is an elevational view of a lighter-key-holder having a circular cross-section wherein the key-holder is a continuation of the body of the lighter.
Figure 1B:
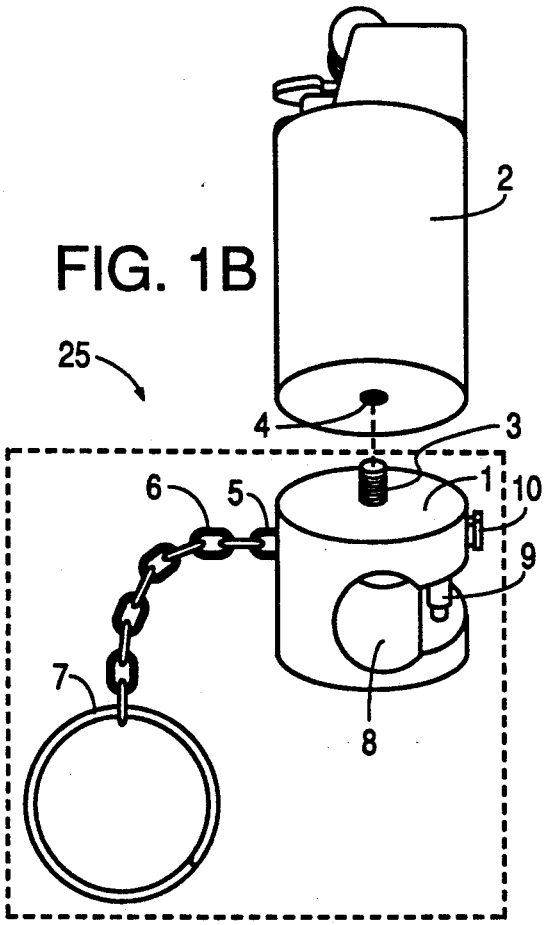
FIG. 1B shows the lighter-key-holder of FIG. 1A with the key-holder detached from the lighter.

The lighter-key-holder arrangement according to the invention is characterized by the fact that the key-holder 25 is independent from the lighter 2. In one embodiment according to the invention, the key-holder 25 comprises a detachable fitting 1 having a cross-section similar to that of lighter 2. Fitting 1 can be attached to lighter 2 by a threaded pin 3 centrally formed on fitting 1 to be received in a threaded bore hole 4 centrally formed in the lower surface of lighter 2, as can be seen in FIG. 1B.

Fitting 1 is provided with a small connecting ring 5 attached to one end of a chain 6. The chain 6 has a key-holder ring 7 connected at an opposite end of the chain 6. Other means may be used to attach chain 6 to connecting ring 5.

Fitting 1 is also provided with a transverse opening 8 which is preferably circular. The transverse opening 8 is closed by a latch 9 which is actuated by a spring (not shown) and manually operated by an external button 10. The transverse opening 8 allows the lighter-key-holder arrangement to be fastened to a belt or to the waistband of a trousers.

Figure 2A:
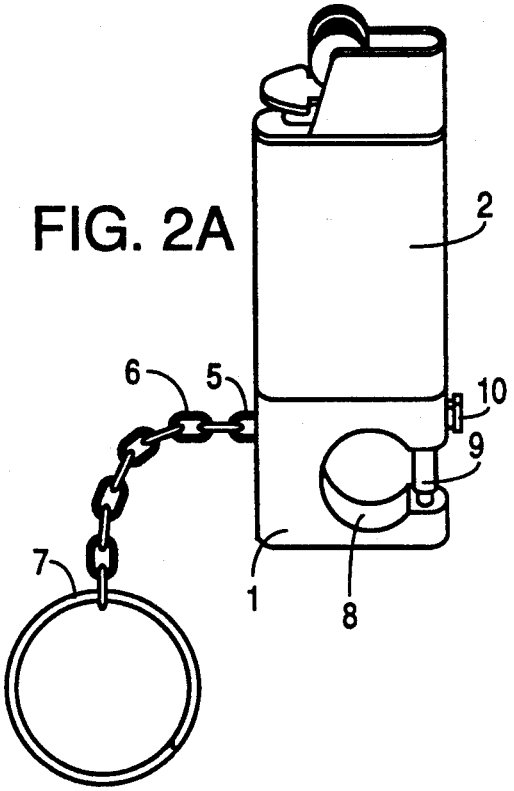
FIG. 2A is an elevational view of a lighter-key-holder having a rectangular cross-section with rounded corners wherein the key-holder is a continuation of the body of the lighter.
Figure 2B:
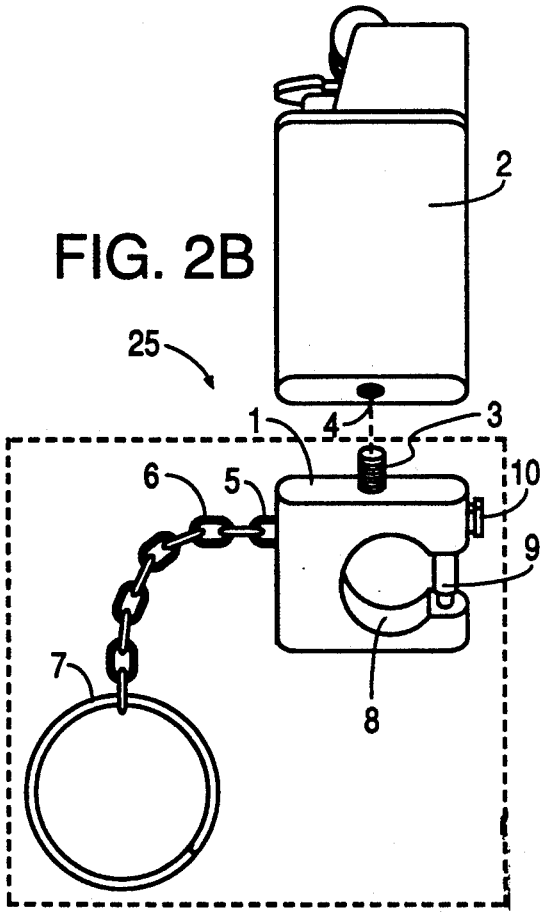
FIG. 2B shows the lighter-key-holder of FIG. 2A with the key-holder detached from the lighter.
Figure 3A:
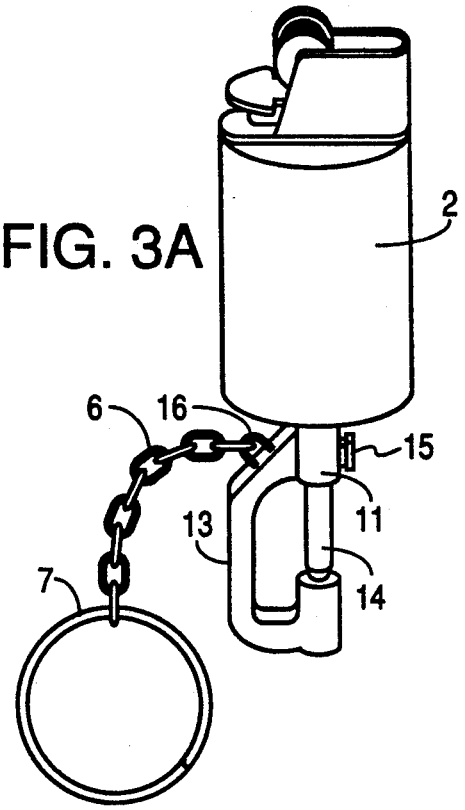
FIG. 3A is an elevational view of a lighter-key-holder wherein the lighter has a circular cross-section and the key-holder is a detachable fitting.
Figure 4A:
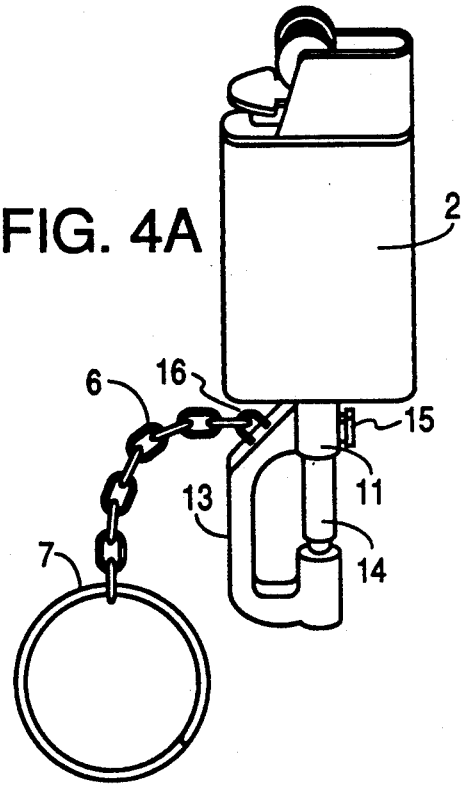
FIG. 4A is an elevational view of a lighter-key-holder wherein the lighter has a rectangular cross-section with rounded edges and the key-holder is a detachable fitting.
Figure 3B:
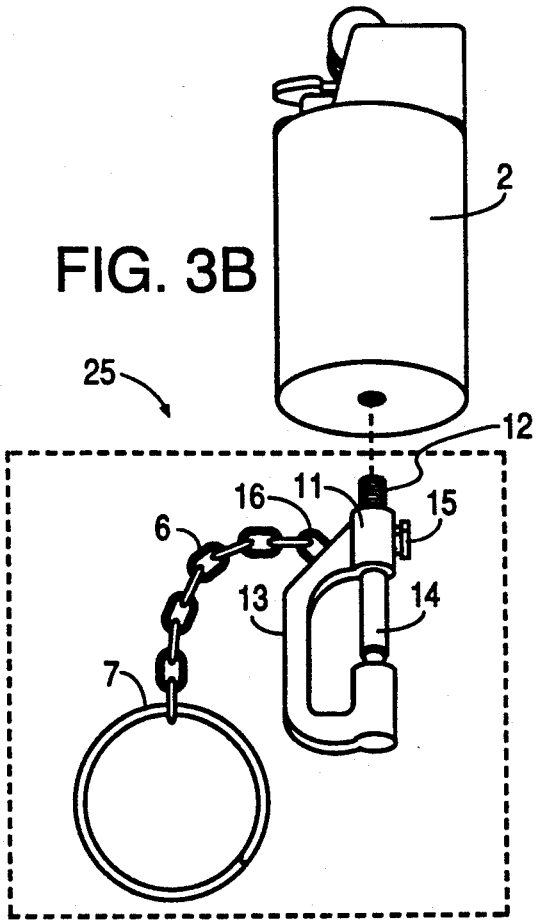
FIG. 3B shows the lighter-key-holder of FIG. 3A with the key-holder detached from the lighter.
Figure 4B:
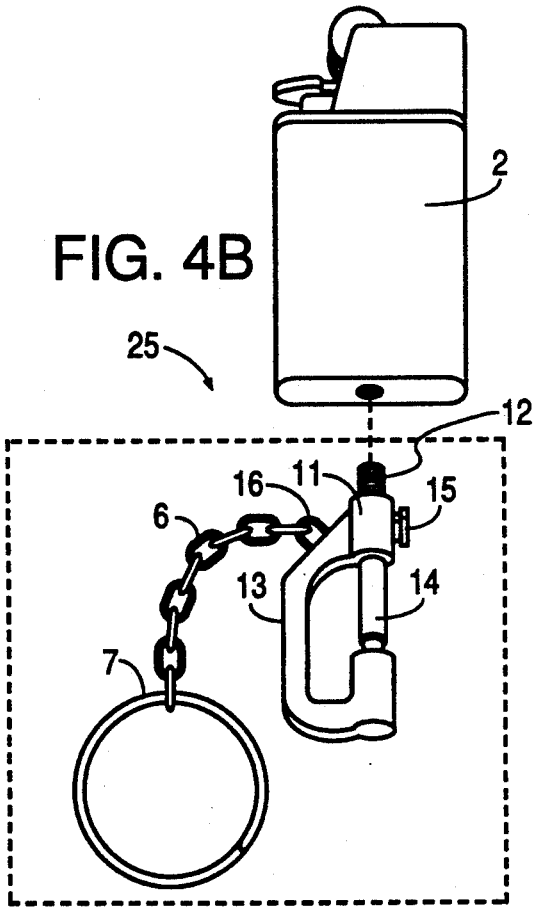
FIG. 4B shows the lighter-key-holder of FIG. 4A with the key-holder detached from the lighter.

Lighter 2 can have a circular (FIGS. 1A–1B) or rectangular (FIGS. 2A–2B) cross-section. In an embodiment according to the invention, fitting 1 has the same cross-section as that of lighter 2.

FIGS. 3A–3B and 4A–4B show additional embodiments of the invention wherein the fitting 1 has a cross-section different than that of the lighter 2. In these embodiments, fitting 1 comprises a shaft 11 having a threaded pin 12 at one end and a C-shaped projection 13. The projection 13 is provided with a latch 14 actuated by a spring (not shown) and manually operated by an external button 15. A connecting ring 16 for fastening the chain 6 of key-holder ring 7 is formed on the C-shaped projection 13. The fitting 1 is attached to the lighter 2 by threading pin 12 into the threaded bore hole 4 of the lighter 2.

Figure 5A:
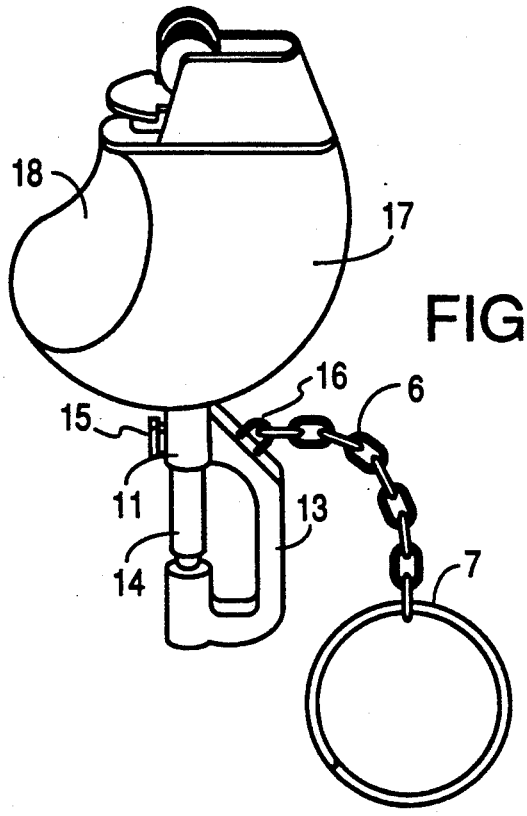
FIG. 5A is an elevational view of a lighter-key-holder wherein the lighter is spherical and the key-holder is a detachable fitting.
Figure 5B:
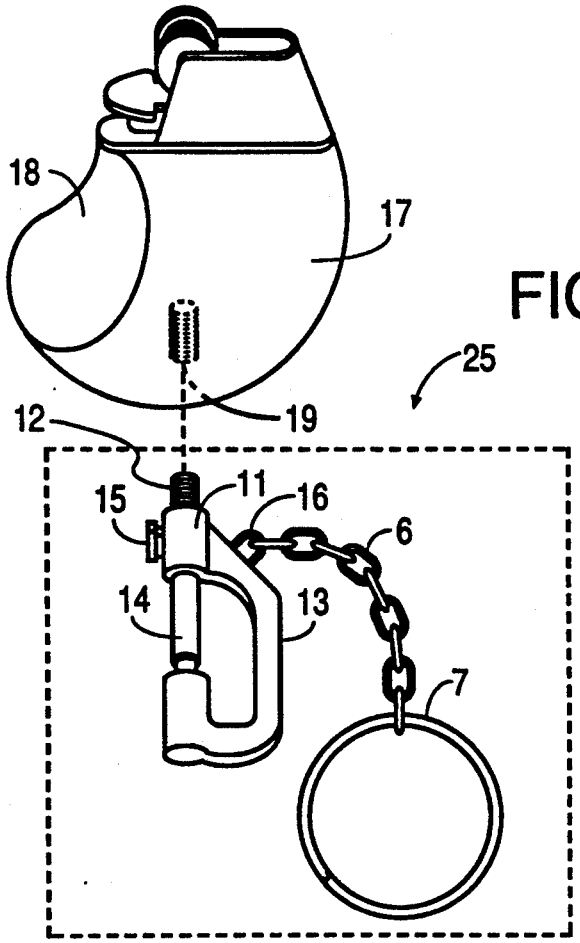
FIG. 5B shows the lighter-key-holder of FIG. 5A with the key-holder detached from the lighter.

In another embodiment of the invention, lighter 2 has a spherical shape with a chamfered portion 18 as shown in FIG. 5. In this embodiment, the lighter 2 is provided with a threaded bore hole 19 at its bottom surface for receiving the threaded pin 12 of fitting 1.

From the above description, taken in connection with the attached drawings, the practical and functional advantages provided by the lighter-key-holder arrangement according to the invention become clear.

I claim:

1. A lighter-key-holder arrangement, comprising:

a lighter having a threaded bore hole formed therein;

a key-holder comprising:

a detachable fitting having a threaded pin formed thereon to be received in said threaded bore hole formed in said lighter, and a transverse opening formed therein, said transverse opening being closed by a latch that is actuated by a spring and manually operated by an external button;

a connecting ring formed on said fitting;

a chain attached at one end to said connecting ring; and a key-holder ring attached to an opposite end of said chain.

2. A lighter-key-holder arrangement as in claim 1 wherein the cross-sectional shapes of the lighter and the fitting are the same.

3. A lighter-key-holder arrangement as in claim 2 wherein the cross-sectional shapes of the lighter and the fitting are circular.

4. A lighter-key-holder arrangement as in claim 2 wherein the cross-sectional shapes of the lighter and the fitting are approximately rectangular.

* * * * *